US007397007B2

(12) United States Patent
Fitzer et al.

(10) Patent No.: US 7,397,007 B2
(45) Date of Patent: Jul. 8, 2008

(54) ASSEMBLY FOR CONTROLLING THE FORCE APPLIED TO A PANTOGRAPH

(75) Inventors: John T. Fitzer, Hazel Green, AL (US); Urs Bischof, Raleigh, NC (US); William Jeffrey Creech, Kenley, NC (US)

(73) Assignee: Siemens Power Transmission & Distribution, Inc., Wendell, NC (US)

( * ) Notice: Subject to any disclaimer, the term of this patent is extended or adjusted under 35 U.S.C. 154(b) by 434 days.

(21) Appl. No.: 11/121,586

(22) Filed: May 4, 2005

(65) Prior Publication Data

US 2006/0131154 A1 Jun. 22, 2006

Related U.S. Application Data

(60) Provisional application No. 60/568,005, filed on May 4, 2004.

(51) Int. Cl.
*H01H 5/00* (2006.01)

(52) U.S. Cl. ..... 200/400; 200/501

(58) Field of Classification Search ..... 200/17 R, 200/48, 500, 501, 400; 361/152, 57, 72; 335/171, 172

See application file for complete search history.

(56) References Cited

U.S. PATENT DOCUMENTS 6,087,913 A * 7/2000 Castonguay et al. ..... 335/16
6,316,742 B1 * 11/2001 Rostron et al. ..... 218/84
6,369,340 B1 * 4/2002 Castonguay et al. ..... 200/244
6,646,216 B2 * 11/2003 Fanta et al. ..... 200/400

* cited by examiner

*Primary Examiner*—Michael A. Friedhofer
*Assistant Examiner*—Lisa N Klaus

(57) ABSTRACT

A method and apparatus for controlling a force applied to a pantograph. A bidirectional snubber and a velocity controller are used to dampen the applied force. Linkages between a shaft and the bidirectional snubber and between the bidirectional snubber and the velocity controller are used to rotationally translate the applied force.

10 Claims, 5 Drawing Sheets

ASSEMBLY FOR CONTROLLING THE FORCE APPLIED TO A PANTOGRAPH

CLAIM OF PRIORITY

This application claims priority to, and incorporates by reference herein in its entirety, pending United States Provisional Patent Application Ser. No. 60/568,005 filed May 4, 2004.

FIELD OF THE INVENTION

The invention is directed to an assembly for controlling a force applied to a MOC (mechanism operated contact) assembly in an electrical switching apparatus such as in a circuit breaker wherein a mechanism within the circuit breaker engages an MOC assembly and applies a force.

BACKGROUND OF THE INVENTION

The opening and closing of contacts within electrical switching equipment has traditionally been done through the use of mechanical switches in electrical components such as circuit breakers, contactors, motor starters, motor controllers and other load controllers. Exemplar switches are disclosed in U.S. Pat. No. 5,856,643, U.S. Pat. No. 4,176,262, and U.S. Pat. No. 4,743,876 and are incorporated herein by reference. Circuit breakers contain separable primary contacts as well as an MOC operator that controls the MOC assembly. In particular, control of the MOC assembly has traditionally been accomplished through mechanical means, and has utilized an interface mechanism such as a pantograph assembly and an MOC operator on the circuit breaker. As originally designed, the MOC operator engages and applies a generally downward force when the circuit breaker closes and upward force when the circuit breaker opens on the MOC assembly. The application of these forces on the MOC assembly causes an MOC rod connected to the MOC assembly to move in corresponding directions and thereby change the status of the MOC assembly.

Due to the various designs employed by various electrical equipment manufacturers, replacement of electrical components such as vacuum circuit breakers which utilize the MOC assembly is often difficult. In particular, pantograph coupling or engagement to the MOC operator is often a dynamic mismatch. The force applied by a new MOC operator to the existing MOC assembly is often significantly higher than that originally designed—in some instances as large as 16 times the force applied by the original MOC operator. Under such circumstances, premature wear, or failure of the MOC assembly is likely. Moreover, the excessive force on the MOC assembly may cause significant contact bounce. Also, the force requirements placed on the circuit breaker can cause stalling of the circuit breaker. Accordingly, there is a need for a method and apparatus for controlling the forces applied to the MOC assembly and which may be readily used and applied to the myriad of brands and types of electrical switching equipment.

SUMMARY OF THE INVENTION

The invention controls the application of a force applied to a pantograph. A bidirectional snubber member is coupled to a shaft within a circuit breaker mechanism to oppose the force transferred to an MOC operator. The snubber opposes the applied force by compressing a spring within the snubber housing and then uncoiling the compressed spring. A velocity controller is used to further augment the opposition forces necessary to dampen the applied force to the pantograph. Rotational linkages between the shaft and the bidirectional snubber and between the bidirectional snubber and the velocity controller are used to translate the force.

BRIEF DESCRIPTION OF THE DRAWINGS

A wide variety of potential embodiments will be more readily understood through the following detailed description, with reference to the accompanying drawings in which.

DESCRIPTION OF THE PREFERRED EMBODIMENT

NUMERIC REFERENCE

Figure 1:
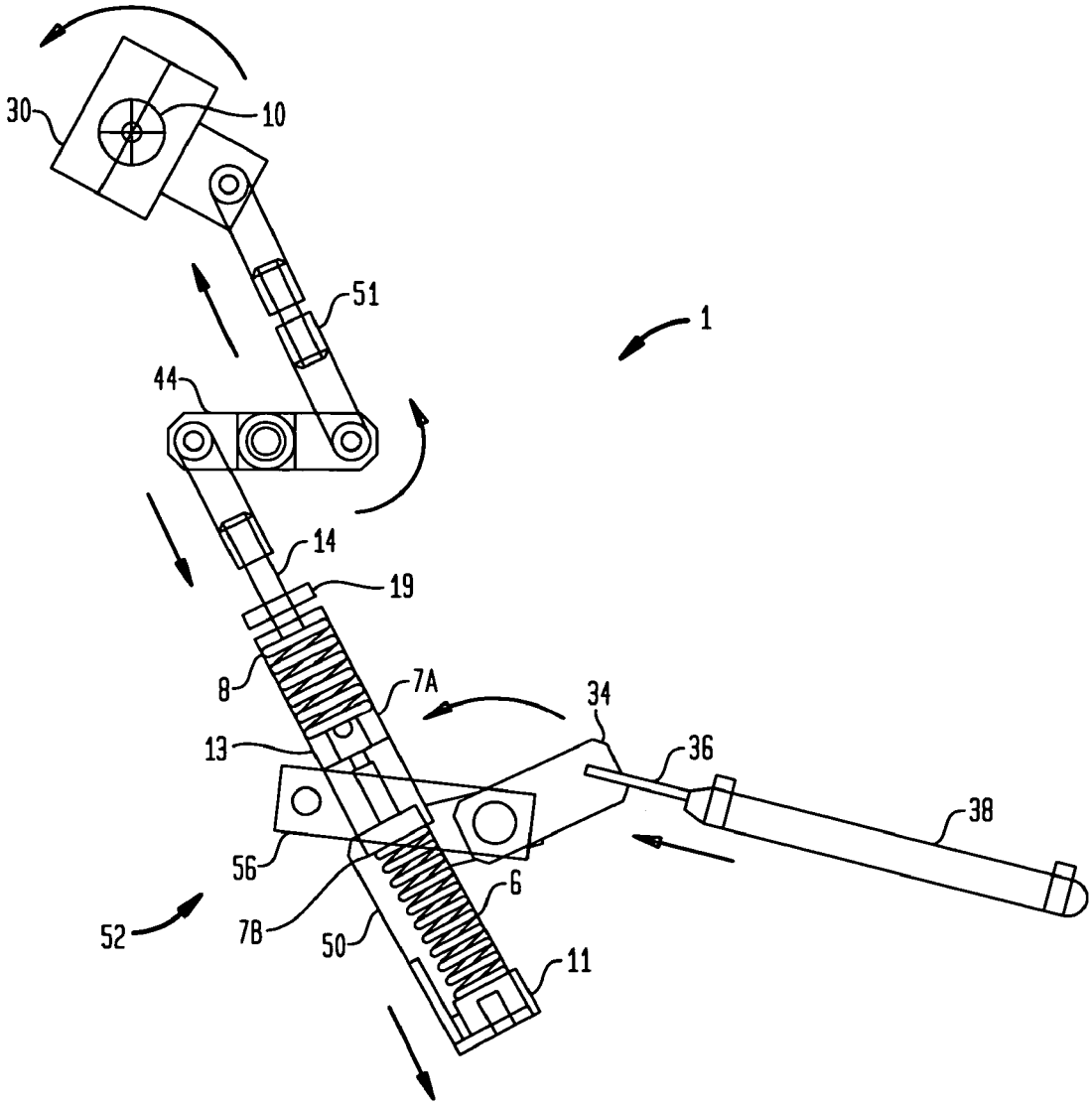
FIG. 1 is an operational side view of the present invention in an open position as applied to an existing bank of auxiliary switches.

1. Circuit Breaker Mechanism
6 Closing Compression Spring
7A Top Plunger Pin
7B Bottom Plunger Pin
8 Opening Compression Spring
10. Main Shaft
11 BDS Plunger bottom
13 BDS Tube
14 BDS Plunger rod
19 BDS plunger top
25. MOC Assembly
30 Clamp Block
34 BVC lever arm
36 BVC Plunger rod
38 Bidirectional Velocity Controller (BVC)
44 BDS Lever Arm
50 BDS Linkage Plate
51 BDS Linkage Rod
52 Bidirectional Snubber (BDS) member
56 MOC Actuator Lever
57 MOC pin
58 Pantograph
60 MOC actuator rod
72 Adjustment Knob (Compression)
74 Adjustment Knob (Extension)

Figure 3:
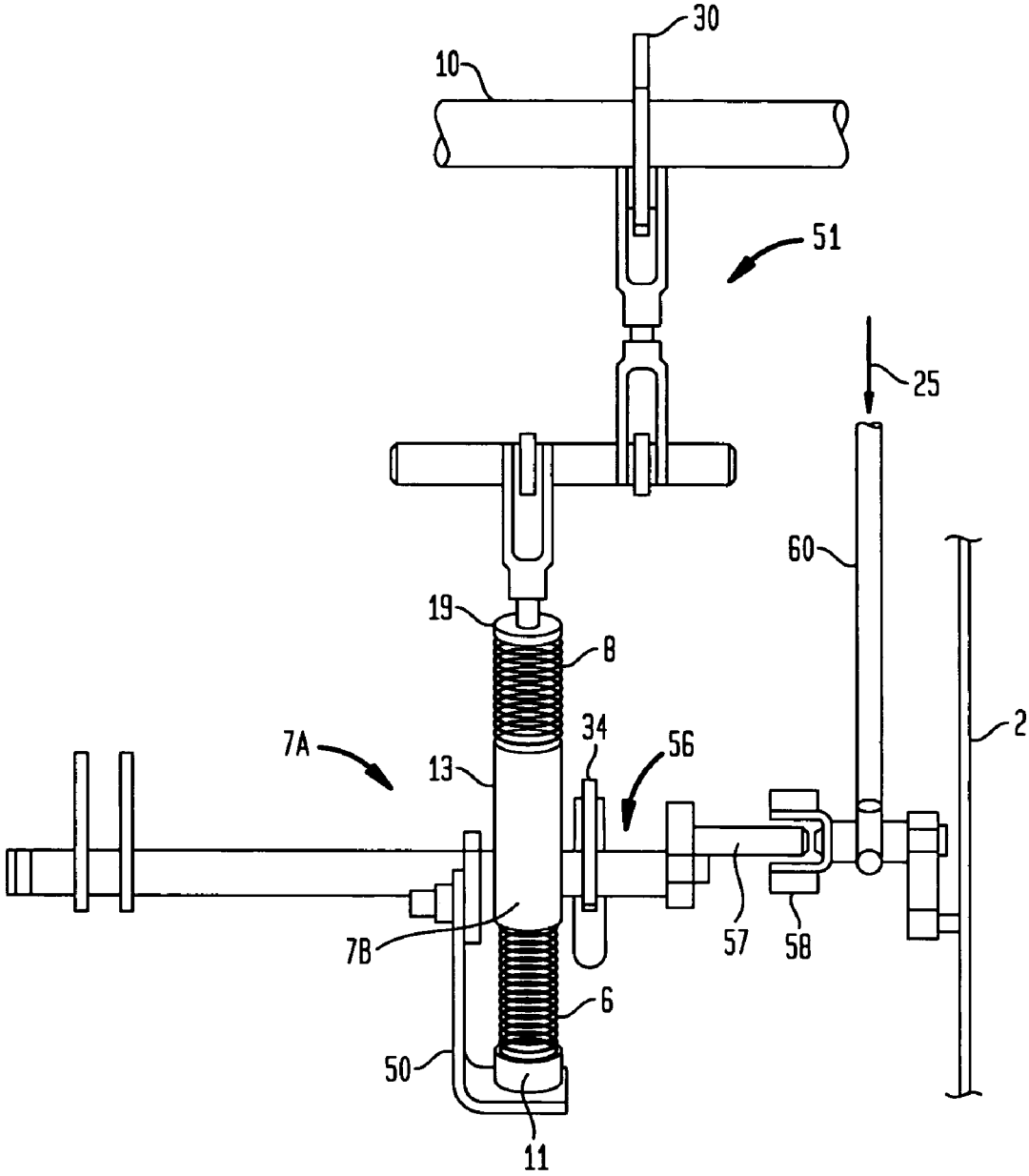
FIG. 3 is an operational frontal view of the present invention in an open position as applied to an existing bank of auxiliary switches.
Figure 4:
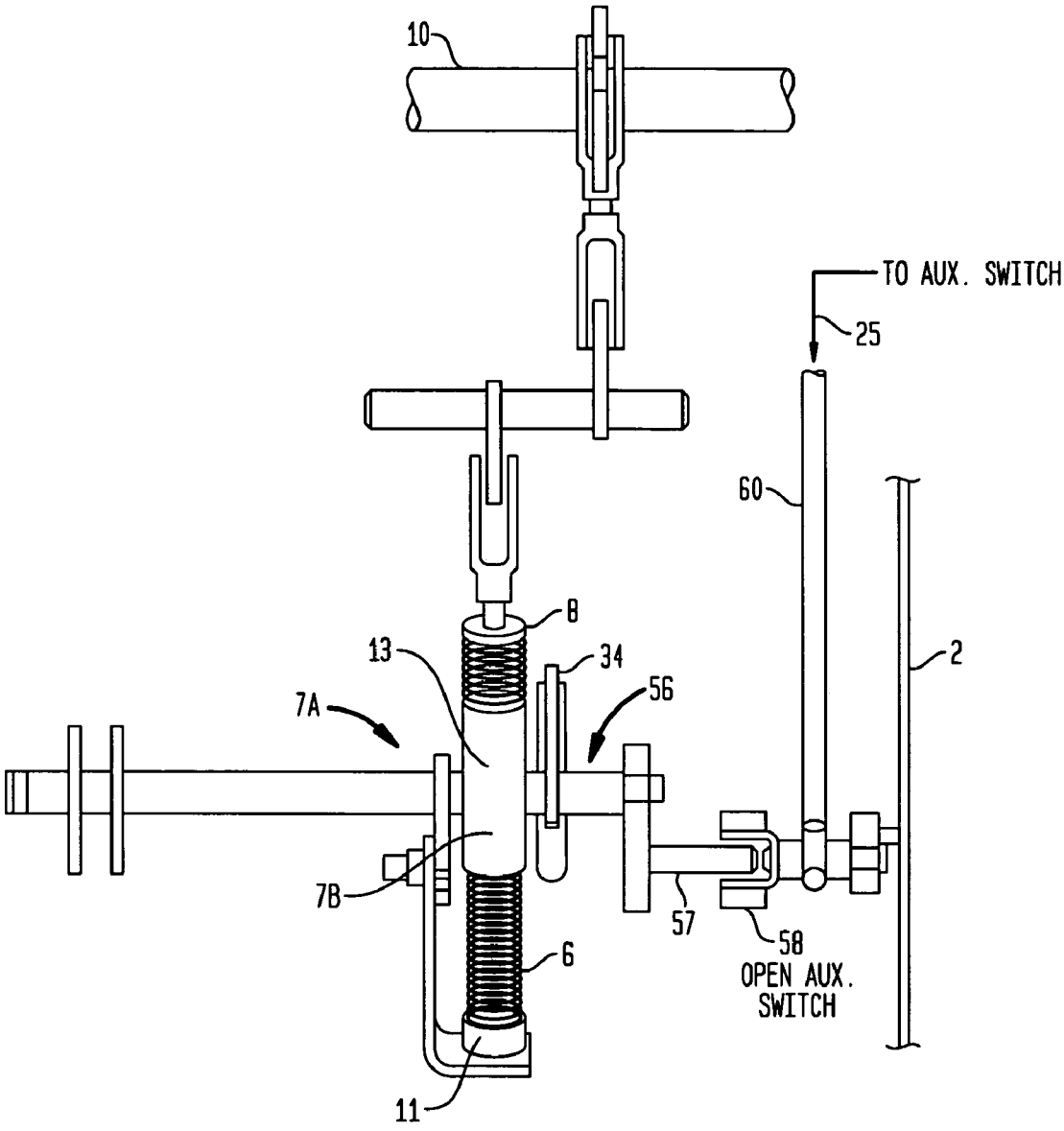
FIG. 4 is an operational frontal view of the present invention in a closed position as applied to an existing bank of auxiliary switches.

FIG. 1 illustrates a portion of a circuit breaker in which an assembly is shown in an open position and is in accordance with the present invention. Within the circuit breaker, main shaft 10 of the circuit breaker operator mechanism 1 is shown. Main shaft 10 rotates in a counterclockwise (CCW) direction when the circuit breaker operates to close its main contacts and main shaft 10 rotates in a clockwise (CW) direction when the circuit breaker operates to open its main contacts. The rotation of main shaft 10 also operates the cubicle mounted MOC assembly 25. (See FIGS. 3 & 4)

Figure 5:
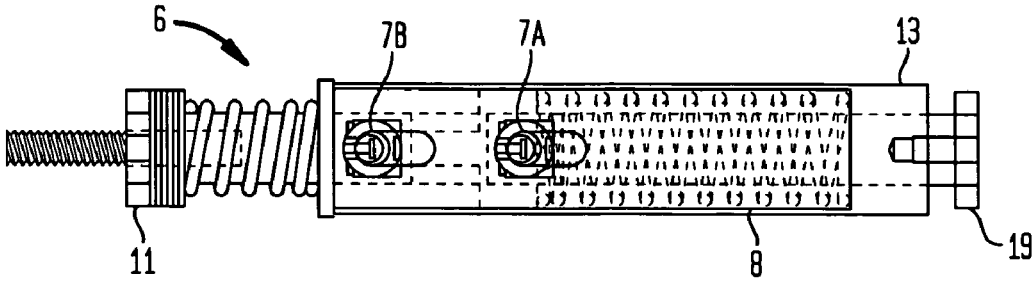
FIG. 5 is a top view of the bidirectional snubber (BDS)
Figure 6:
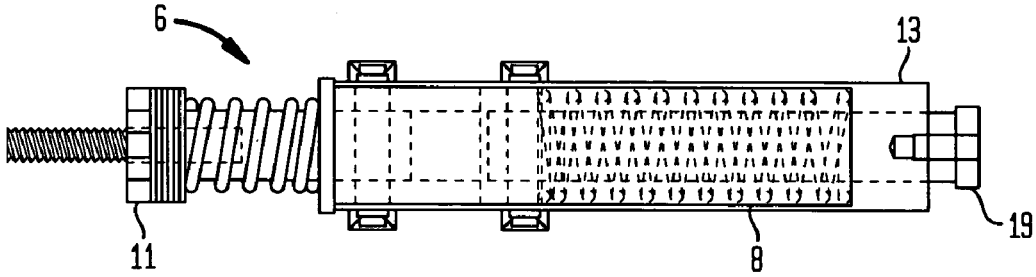
FIG. 6 is a side view of the (BDS)

The main shaft 10 and clamp block 30 rotate with substantially the same rotational velocity. Clamp block 30 connects to bidirectional snubber (BDS) linkage rod 51 of BDS 52 (FIGS. 5 & 6) and is moved in substantially a downward direction during a circuit breaker close operation. BDS linkage rod 51 is connected to a rotatable BDS lever arm 44. The assembly shown in FIG. 1 includes BDS lever arm 44, however this is only representative of this particular embodiment and is not required for all circuit breaker assemblies. The BDS lever arm 44 is provided in this embodiment as a means of achieving a translation or a reversal of directional movement and may be substituted with other means known to those skilled in the art. As shown in FIG. 1, BDS lever arm 44 is connected at one end to BDS linkage rod 51 and on the other end to BDS plunger rod 14. The BDS plunger rod 14 is connected to the bidirectional snubber (BDS) member 52 at BDS plunger top 19. BDS member 52 is connected to BDS linkage plate 50. The BDS plunger rod 51, BDS plunger top 19, BDS plunger bottom 11, springs 8 and 6, and BDS tube 13 comprise BDS member 52. BDS linkage plate 50 is connected to rotatable bidirectional velocity controller (BVC) lever arm 34 which also connects to the MOC actuator lever 56. BVC lever arm 34 is connected to the bi-directional velocity controller (BVC) 38. The bottom end of the BVC 38 is mounted to the circuit breaker frame. Rotation of the BVC lever arm 34 also rotates MOC actuator lever 56. The MOC pin 57 of the MOC actuator lever 56 engages the cubicle mounted pantograph 58. The use of a pantograph 58 is only one of a myriad of possible solutions (linkages) used by original equipment manufacturers such as Westinghouse Electric. Other linkages were provided by various other original equipment manufacturers. The pantograph 58 is connected to the MOC actuator rod 60. MOC actuator rod 60 connects to cubicle mounted MOC switch assemblies 25

Circuit breaker operation from an open position to a closed position is shown in FIG. 1, requires the rotation of main shaft 10 and clamp block 30 in a counter-clockwise (CCW) direction. Main shaft 10 and clamp block 30 are connected to BDS linkage rod 51. Closing the circuit breaker moves BDS linkage rod 51 in substantially an upward direction. Upward movement of BDS linkage rod 51 rotates BDS lever arm 44 in CCW direction. CCW rotation of BDS lever arm 44 moves the BDS plunger rod 14 and BDS plunger top 19 in substantially a downward direction. The top plunger pin 7A (right hand pin in FIG. 5) pushes against a slot and moves BDS tube 13 substantially downward. The movement of BDS tube 13 substantially downward stores energy in the closing compression spring 6. After the energy is stored in the close spring 6 and the substantially downward movement of the BDS tube 13 has stopped, the energy in the close spring 6 is discharged so as to move the BDS plunger bottom 11 substantially downward. The velocity of movement of the BDS plunger bottom 11 is controlled by BVC 38. The downward movement of the BDS plunger bottom 11 moves the BDS linkage plate 50 downward. Downward movement of the BDS linkage plate 50 rotates the BVC lever arm 34 CCW. CCW rotation of the BVC lever arm 34 pulls tension on the BVC plunger rod 36 of BVC 38. The BVC 38 controls and reduces the rotational velocity of the BVC lever arm 34.

The CCW rotation of the BVC lever arm 34 causes CCW rotation of the MOC actuator lever 56. The MOC pin 57 of MOC actuator lever 56 moves the cubicle mounted pantograph 58 substantially downward. The downward movement of the pantograph 58 moves the MOC actuator rod 60 substantially downward to operate the cubicle mounted MOC auxiliary assembly 25 (not shown).

Figure 2:
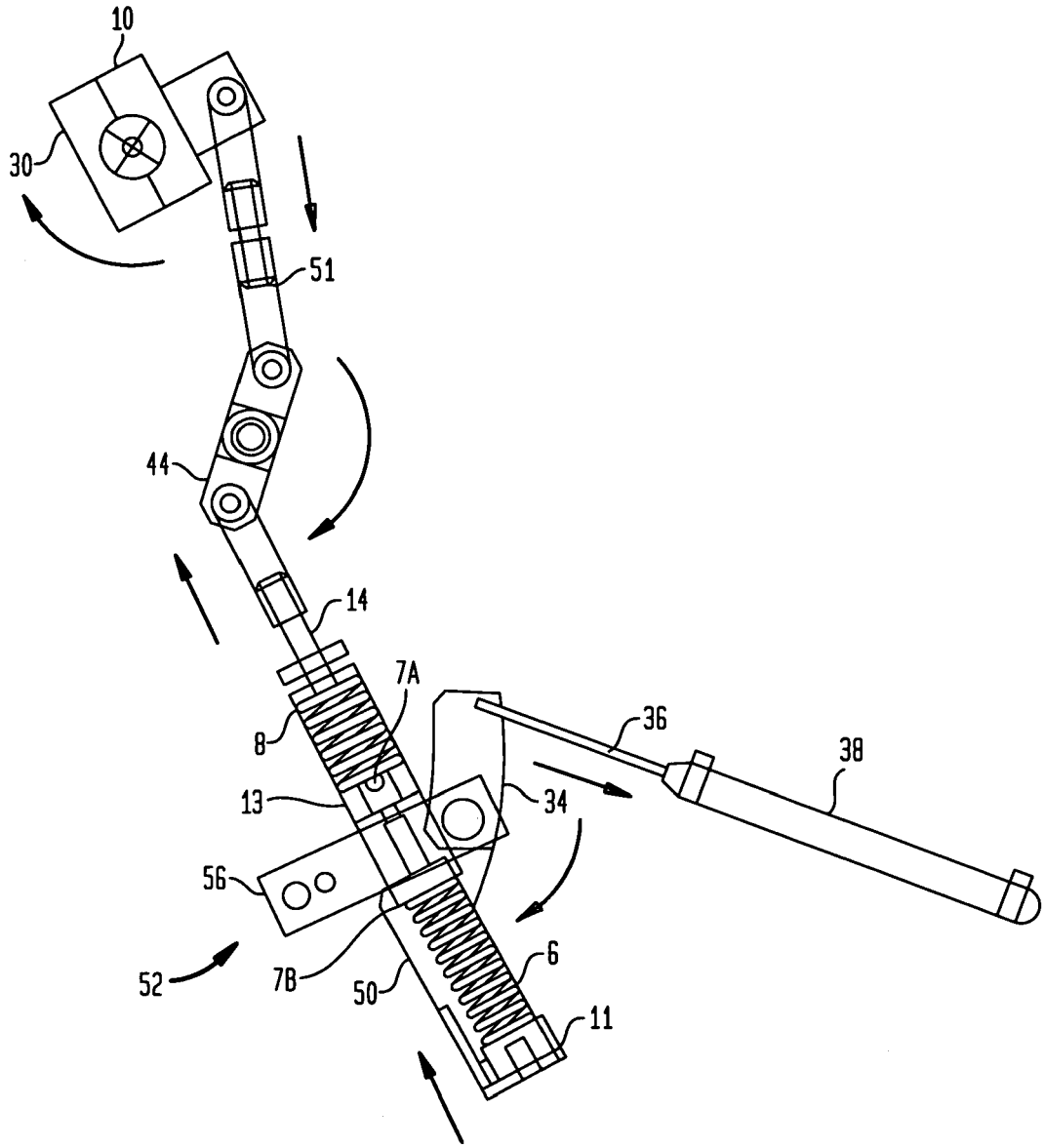
FIG. 2 is an operational side view of the present invention in a closed position as applied to an existing bank of auxiliary switches.

Circuit breaker operation from a closed position to an open position is shown in FIG. 2. Main shaft 10 and clamp block 30 rotate clockwise (CW). Main shaft 10 and clamp block 30 are connected to BDS linkage rod 51. Opening the circuit breaker moves BDS linkage rod 51 in substantially a downward direction. Downward movement of BDS linkage rod 51 rotates BDS lever arm 44 in CW direction. CW rotation of the BDS lever arm 44 moves BDS plunger rod 14 in substantially an upward direction. The BDS plunger 14 is pulled and energy is stored in the opening compression spring 8. After the energy is stored in the opening spring 8 and the upward movement of BDS tube 13 has stopped, the energy in the opening spring 8 is discharged so as to move BDS tube 13 substantially upward. The upward movement of BDS tube 13 pulls against bottom plunger pin 7B (LH in FIG. 5) which rides against the end of the slot in the BDS tube 13. The bottom plunger pin 7B is connected through the BDS plunger bottom 11. Discharge of the opening compression spring 8 results in substantially an upward movement of the BDS plunger bottom item 11. The velocity of the movement of the BDS plunger bottom 11 is controlled by the BVC 38. The upward movement of the BDS plunger bottom 11 moves the BDS linkage plate 50 upward. Upward movement of the BDS linkage plate 50 rotates the BVC lever arm 34 CW. CW rotation of the BVC lever arm 34 pushes compression on the BVC plunger rod 36. The BVC 38 controls and reduces the velocity of the BVC lever arm 34.

The CW rotation of the BVC lever arm 34 causes CW rotation of the MOC actuator lever 56. The MOC pin 57 of the MOC actuator lever 56 moves the cubicle mounted pantograph 58 substantially upward The upward movement of the pantograph 58 moves the MOC actuator rod 60 substantially upward to operate the cubicle mounted MOC assembly 25 (not shown).

Figure 7:
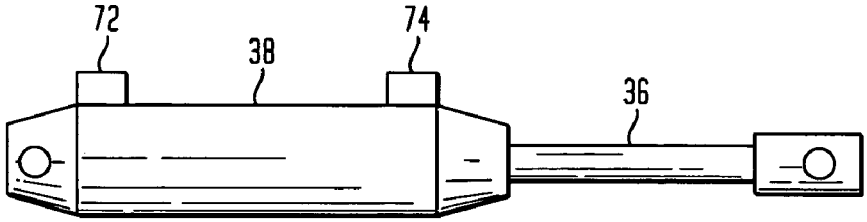
FIG. 7 is a side view of the bidirectional velocity controller (BVC).

The BVC plunger rod 36 is preferably coupled to BVC 38 in a slidable, bidirectional, controllable and resistive manner. The BVC 38 is preferably a hydraulic speed or feed controller (See FIG. 7). However, other types of velocity and feed controllers as known to one skilled in the art, may be used. In the embodiment shown in FIG. 1, the BVC 38 is a dual and bi-directional feed velocity controller. Both tension and compression regulation is provided by BVC 38. Operationally, BVC 38 provides a tension and compression force, ranging from 9.5 lbs (min) to 450 lbs (max). The regulation of tension or compression forces may be adjustable or fixed. The other end of BVC 38 is attached to the circuit breaker frame.

In the embodiment shown in FIGS. 1 & 2, BDS member 52 comprises an BDS tube 13 having an upper and lower region. The arrangement of springs may be reversed for different embodiments. BDS member 52 has an opening compression spring 8 in the upper region within an inner chamber. When, the BDS member 52 is subjected to a circuit breaker opening operation, the BDS plunger top 19 is forced into the BDS member 52, so as to compress the opening compression spring 8. In this position, opening compression spring 8 is compressed while a closing compressing spring 6 remains unaffected by the compression of the opening compression spring 8.

When the BDS member 52 is subjected to a circuit breaker closing operation, the BDS plunger bottom 11 is forced into the BDS member 52, so as to compress the closing compression spring 6. In this position, closing compression spring 6 is compressed while the opening compression spring 8 remains unaffected by the compression of the closing spring 6. The closing and opening compression springs 6, 8 are set apart from each other.

Operationally, an external signal, such as a protective relay senses an over current condition, operates (trips) the circuit breaker to open both the primary contacts and the MOC assembly auxiliary contacts 25. From a closed position, the tripping of the circuit breaker causes the main shaft 10 to rotate clockwise an estimated 60 degrees. The rotation of the main shaft 10 causes the clamp block 30 to also rotate in a clockwise direction. The rotation of the clamp block 30 and the main shaft 10 has the direct effect of pulling the BDS linkage rod 14 substantially upward and the BVC rod 36 downward. The clockwise rotation of clamp block 30 causes the BVC lever arm 34 to rotate in a clockwise direction about its pivot pin. The clockwise movement of the BVC lever arm 34 also causes the downward application of a force on BVC rod 36 so as to cause BVC rod 36 to travel in the inward direction within BVC 38. In the embodiment shown in FIGS. 1 & 2, the BVC 38 is a hydraulic feed controller containing automatic transmission fluid (ATF). However it should be understood that the BVC 38 (FIG. 7) may contain other fluids, gases and/or solids alone or in combination capable of resisting compression in a controllable manner. The BVC's 38 resistance to compression controls the velocity at which the MOC pin 57 moves the pantograph 58.

The foregoing Detailed Description of the Preferred Embodiment is to be understood as being in every respect illustrative and exemplary. The scope of the invention disclosed herein is not to be determined from the description of the invention, but rather from the Claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention.

What is claimed is:

1. An apparatus for controlling a mechanism operated contact assembly comprising;

a rotatable main shaft operable between an open and a closed position;

a bidirectional snubber member (BDS) coupled to the main shaft for controlling a force applied to a pantograph, the BDS comprising:

a BDS plunger rod having a BDS plunger top and a BDS plunger bottom;

a BDS plunger tube disposed around the BDS plunger rod and reciprocally movable along the BDS plunger rod between the BDS plunger top and the BDS plunger bottom;

an opening spring disposed around the BDS plunger rod proximate the BDS plunger top and reciprocally movable along the BDS plunger rod responsive to movement of the BDS plunger rod; and a closing spring disposed around the BDS plunger rod proximate the BDS plunger bottom and reciprocally movable along the BDS plunger rod responsive to movement of the BDS plunger tube; and a first means for linking the rotatable main shaft with the BDS.

2. The apparatus of claim 1 wherein the first means for linking comprises a BDS lever arm.

3. The apparatus of claim 2, further comprising a first linkage rod for connecting the main shaft and the BDS lever arm.

4. An apparatus for controlling a mechanism operated contact assembly comprising;

a rotatable main shaft operable between an open and a closed position;

a bidirectional snubber member (BDS) coupled to the main shaft for controlling a force applied to a pantograph, the BDS having an opening spring and a closing spring; and a first means for linking the rotatable main shaft with the BDS; wherein the first means for linking comprises a BDS lever arm; further comprising a first linkage rod for connecting the main shaft and the BDS lever arm; further comprising a BDS plunger rod coupled to the BDS; and wherein the lever arm rotates in an opposite direction to the rotational direction of the main shaft.

5. The apparatus of claim 4 further comprising a second rotational linkage coupled to the BDS.

6. The apparatus of claim 5, further comprising a bidirectional velocity controller (BVC) coupled to the second rotational linkage.

7. The apparatus of claim 6, wherein the BVC comprises a BVC plunger rod, the BVC plunger rod coupled to the second rotational linkage.

8. The apparatus of claim 7 wherein the BVC comprises a means for adjusting the tension between the second rotational linkage and the BVC plunger rod.

9. The apparatus of claim 8, wherein the second rotational linkage comprises a BVC lever arm, the BVC lever arm coupled to the BVC plunger rod.

10. An apparatus for controlling a mechanism operated contact assembly comprising;

a rotatable main shaft operable between an open and a closed position;

a bidirectional snubber member (BDS) coupled to the main shaft for controlling a force applied to a pantograph, the BDS comprising:

a BDS plunger rod having a BDS plunger top and a BDS plunger bottom;

a BDS plunger tube disposed around the BDS plunger rod and reciprocally movable along the BDS plunger rod between the BDS plunger top and the BDS plunger bottom;

an opening spring disposed around the BDS plunger rod proximate the BDS plunger top and reciprocally movable along the BDS plunger rod responsive to movement of the BDS plunger rod; and a closing spring disposed around the BDS plunger rod proximate the BDS plunger bottom and reciprocally movable along the BDS plunger rod responsive to movement of the BDS plunger tube;

first means for linking the rotatable main shaft with the BDS;

means for controlling rotational velocity; and second means for linking the BDS with the means for controlling rotational velocity, wherein the means for controlling rotational velocity controls the rotational velocity of the second means for linking.

* * * * *